US007169012B2

(12) United States Patent
Ruiz-Schneider et al.

(10) Patent No.: US 7,169,012 B2
(45) Date of Patent: Jan. 30, 2007

(54) HYDRODYNAMIC RADIAL FLUX POLISHING AND GRINDING TOOL FOR OPTICAL AND SEMICONDUCTOR SURFACES

(76) Inventors: Elfego Guillermo Ruiz-Schneider, Juarez Oriente 208, Contadero, Del. Cuajimalpa, C.P. 05500 (MX); Erika Sohn-Lopez-Forment, Ocotepec 267, San Jeronimo Lidice, Del. Magdalena Contreras, C.P. 10200. Mexico D.F. (MX); Luis Salas-Casales, Aragon 15, Fracc. Chapultepec-2da. Sección, C.P. 22860, Ensenada, Baja California (MX); Esteban Antolin Luna-Aguilar, Avenida Mar 633, Zona Centro, C.P. 22800, Ensenada, Baja California (MX)

( * ) Notice: Subject to any disclaimer, the term of this patent is extended or adjusted under 35 U.S.C. 154(b) by 0 days.

(21) Appl. No.: 11/327,786

(22) Filed: Jan. 5, 2006

(65) Prior Publication Data

US 2006/0141906 A1 Jun. 29, 2006

(51) Int. Cl.
*B24C 3/00* (2006.01)

(52) U.S. Cl. ..... 451/2; 451/38

(58) Field of Classification Search ..... 451/2, 451/38–40, 75, 87, 91, 102
See application file for complete search history.

(56) References Cited

U.S. PATENT DOCUMENTS 5,786,236 A 7/1998 Thompson
5,969,368 A 10/1999 Thompson
5,971,824 A 10/1999 Cho
6,106,380 A 8/2000 Jacobs
6,354,923 B1 * 3/2002 Lankford ..... 451/72

FOREIGN PATENT DOCUMENTS

DE 101 13 599 * 2/2002

OTHER PUBLICATIONS

Booij, S.M. et al., "Nanometer Deep Shaping with Fluid Jet Polishing," Delft University of Technology, s.m.booij@tnw.tudelft.nl.
Fahnle, Oliver W. et al., "Fluid Jet Polishing of Optical Surfaces," Applied Options, vol. 37, No. 28, Oct. 1, 1998, pp. 6771-6773.

(Continued)

*Primary Examiner*—Dung Van Nguyen
(74) *Attorney, Agent, or Firm*—Eric Hanscom; Ryan Friedl

(57) ABSTRACT

A polishing tool useful for grinding and high precision, fine polishing of flat or curved optical surfaces, as well as for the optical flattening of semiconductor and metallic surfaces. The tool does not make contact with the surface to be polished and lacks moving parts; but produces a high velocity flux "cushion" that expands radially and parallel to the working surface, generating a stable, uniform and repeatable annular abrasion footprint. Due to the hydrodynamic characteristics of the tool, it can create polished surfaces of high-precision optical quality starting from the grinding process up through the final fine polishing process without having to change the tool, thereby avoiding friction against the work surface and tool wear. It can polish thin membranes and does not require a rigid or active support for the working surface. This invention considerably simplifies optical polishing processes and reduces costs with respect to other known methods.

20 Claims, 6 Drawing Sheets

OTHER PUBLICATIONS

Fahnle, Oliver W. et al., "Finishing of Optical materials Using Fluid Jet Polishing,", DeCos, Delft Center for Optical Surfaces, TNO Institute of applied Physics, The Netherlands—oliver.faehnle@fisba.ch.

Booij, Silvia M. et al, "Jules Verne- a New Polishing Technique Related to FJP," Optics Research Group, Delft Univ. of Technology, The Netherlands s.m.booij@tnw.tudelft.nl.

E. Sohn et al., "HyDra: a novel hydrodynamic polishing tool for high quality optical surfaces," Astronomy Institute, National Astronomical Observatory, UNAM, Mexico, D.F., Mexico, sohn@astroscu.unam.mx, 3 pages.

E. Sohn et al., "Hydra: a novel hydrodynamic polishing tool for high quality optical surfaces," Astronomy Institute, National Astronomical Obsevatory, UNAM, Mexico, D.F. Mexico, sohn@astroscu.unam.mx, 3 pages (a variation).

Jorge Gonzalez-Garcia et al., "Static dynamic removal rates of a new hydrodynamic polishing tool," Applied Optics, vol. 43, No. 18, Jun. 20, 2004, pp. 3623-3631.

E. Ruiz et al., "New Perspectives in Hydrodynamic Radial Polishing Techniques for Optical Surfaces," Astronomy Institute, National Astronomical Observatory, UNAM, Mexico D.F., Mexico, elfego@astroscu.unam.mx.

* cited by examiner

HYDRODYNAMIC RADIAL FLUX POLISHING AND GRINDING TOOL FOR OPTICAL AND SEMICONDUCTOR SURFACES

CROSS REFERENCE TO RELATED APPLICATIONS

This patent application derives from PCT Application No. WO 2005/007343 A1, a copy of which is attached to this application.

STATEMENT REGARDING FEDERALLY SPONSORED RESEARCH OR DEVELOPMENT

This invention was not federally sponsored.

Terminology Used

The following terms are defined for the better understanding of the descriptions given in this document:

Figuring: The process of shaping a solid object, three dimensional surface, usually using a mathematical equation by means of one or more rigid, flexible or fluid jet abrasive tools, yielding a final error of around 100 μm.

Grinding: The process used after figuring a surface, consisting of removing material from the surface of a solid object by means of shearing, cutting or impacting action of microscopic particles with a high degree of hardness (final error of 1–10 μm).

Fine polishing: The final finishing of a specular surface with surface errors and micro-roughness smaller than 20 nm.

Stability: The ability of the tool to maintain a constant erosion footprint during operation.

Repeatability: The ability of the tool to maintain a constant erosion footprint during several operating cycles.

Uniformity: The ability of the tool to maintain a constant erosion footprint along its annular circumference.

BRIEF SUMMARY OF KEY COMPONENTS OF THE INVENTION

This invention is directed toward a polishing tool useful for grinding and high precision, fine polishing of flat or curved optical surfaces, as well as for the optical flattening of semiconductor and metallic surfaces. The tool does not make contact with the surface to be polished and lacks moving parts; it is made of stainless steel and ceramic materials. Due to the hydrodynamic characteristics of the tool, it can create polished surfaces of high-precision optical quality. Regarding its functionality, the tool produces a high velocity flux that expands radially and parallel to the working surface, generating a stable, uniform and repeatable annular abrasion footprint. The design of the tool allows it to create an optical surface starting from the grinding process up through the final fine polishing process without having to change the tool, thereby avoiding friction against the work surface as well as tool wear. It can polish thin membranes and does not require a rigid or active support for the working surface. This invention considerably simplifies optical polishing processes and reduces costs with respect to other known methods.

FIELD OF THE INVENTION

This invention relates to the field of corrective lapping/grinding and high precision polishing, specifically for optical surfaces as well as the flattening of semiconductor materials.

BACKGROUND OF THE INVENTION

There are a number of fabrication processes which require the creation of extremely finely finished surfaces. Two of the most obvious fields are semiconductor surfaces and optics. The process of high quality optical polishing consists of removing material from the surface of the optical device to be polished in order to smooth it, as well as to correct its figure with precisions of up to fractions of a wavelength. For semiconductor surfaces, a smooth surface free of irregularities is essential for a quality product, and requires a precision flattening or smoothing process to create the desired surface.

Conventional polishing methods, also known as classic polishing methods (R. N. Wilson "Reflecting Telescope Optics II, Manufacture, Testing, Alignment Modern Techniques", Springer Verlag, 1999 and Wilson S. R. et al. SPIE VOI 966, 74, 1988), primarily make use of contact tools fabricated with elastic materials such as pitch, polyurethane, etc., that precisely conform themselves to the working surface, abrading it by means of a layer of slurry. These polishing procedures tend to be manual and slow, and the polishing tools tend to strain under the effects of temperature and stresses that are generated during the polishing process, thus wearing away the polishing tool with encrusted abrasive particles and removed material.

These methods have been overcome with the use of so called "stressed lap" polishing tools, which consist of actively deformable polishing tools which ease the polishing of aspheric surfaces. Nevertheless, these methods are complex and have limitations such as their inability to precisely polish the edges of the working surface, inevitably resulting in fallen edges.

A series of modern methods have been developed that enable the fine polishing of optical surfaces, such as ion beam figuring, magnetorheological polishing and fluid jet polishing. The features and limitations of each of these methods are described below:

The ion beam method (as illustrated by U.S. Pat. Nos. 5,969,368 and 5,786,236) is based on the bombardment of the working surface by means of a collimated ion beam, composed of an inert gas that removes material from the polishing surface. Although it is possible to polish aspheric surfaces as well as not producing fallen edges, the surface micro-roughness is not improved due to perpendicular impacting of the ions with the surface. Only fine polishing of a previously ground and polished surface can be achieved with this technology. This process corrects the surface errors iteratively, based on an error map of the working surface.

This method requires the use of a vacuum chamber, at least of the size of the working surface, resulting in an expensive and complex procedure. The magnetorheological fluid polishing method (as illustrated by U.S. Pat. Nos. 5,971,835 and 6,106,380) is based on the confinement of a magnetic fluid containing abrasive material over the perimeter of a rotary cylinder which, under the influence of a magnetic field, hardens, thus forming a polishing tool. The polishing effect is achieved by moving the working piece in a controlled manner over the hardened magnetorheological polishing fluid that flows over the cylinder. Another variation of this method consists of collimating a beam of magnetorheological abrasive fluid by means of a magnetic field and impacting it against the working surface.

Although this method generates an annular footprint on the working surface, the areas that can be polished are small (less than 5 mm). This limits this technology to industrial applications of small optics such as microscope and camera lenses, and is quite expensive.

The fluid jet polishing method (FJP) (as described in Booij, S. M., Optical Engineering, Aug. 2002, Vol. 41, no. 8, pp 1926–1931 and Booij, S. M. et al., I.OF & T conference, Tucson, Jun. 2002, pp. 52–54 and O. Faehnle et al. Appl. Optics 38, 6771–673, 1998) is the first polishing technology based on the use of fluids. It produces wear on the working surface by means of an abrasive fluid. The beam is aimed at the surface through a nozzle with a certain angle and distance with respect to the working surface. This polishing method presents certain limitations since the generated footprint is unidirectional and lacks axial symmetry. This method only allows for polishing of small surfaces and the tool presents limitations to satisfy the high precision polishing needs in the field of large area optics.

Technical Problem

Thus, there remains a long-felt need in the high precision optical polishing and microelectronics fields, specifically the precise flattening of semiconductor wafers, the grinding and polishing procedures used make use of a series of modern techniques which nonetheless present certain limitations:

Lap Polishing (Classic):

- This method only allows for high hardness materials.
- The working surface is deformed by the applied tool pressure, requiring the use of rigid supports for the optical piece.
- Lap tools tend to generate fallen edges due to their semi-rigid contact material and the lack of tool support near the edges of the surface to be polished.
- It is necessary to change the tool size in order to make zonal corrections.
- This method uses harmonic machines which do not have the advantages of a Cartesian machine.

Fluid Jet Polishing (FJP):

- Up to now it is impossible to polish large surfaces (Φ~1–8 m).
- Material removal rates are between 100 and 1000 times smaller than the rates obtained with the present invention.
- The tool footprint does not present radial symmetry; it is not possible to produce a uniform annular print in the plane of incidence; ie. the footprint in the x direction is different form the footprint in the y direction. This complicates the handling of the tool, as well as of the working surface.

Magnetorheological Polishing:

- The main disadvantage of this method is the reduced footprint size that can be generated.
- It is not possible to generate a uniform annular erosion footprint in the plane of incidence, ie. no axial symmetry exists for the footprint. This complicates the handling of the tool, as well as of the working surface.

Ion Beam Figuring:

- A vacuum chamber of at least the size of the surface to be polished is required.
- It is not possible to make interferometric optical tests during the polishing process, this complicates the iterative polish/test procedure.
- The surface micro-roughness is not improved due to the normal incidence of the beam on the surface.

One of the main limitations in the available fine polishing and grinding technology is that it is necessary to use more than one polishing technique in order to obtain a high quality, precision optical surface. Currently these techniques are achieved in different geographic locations, complicating the process and significantly elevating the manufacturing costs.

Thus there has existed a long-felt need for a method of creating smooth surfaces in optics and semiconductors and a tool of accomplishing the same, which is usable over a large surface area, and is relatively inexpensive to use when compared with current methods and tools in this field.

The present invention solves or improves the current technological problems and a series of advantages are obtained with respect to the techniques mentioned earlier in this document.

DESCRIPTION

The tool and method of use disclosed in this application is useful for the corrective lapping and fine polishing of diverse materials by means of a low cost, abrasive flux and a novel suspension system that does not make contact with the working surface. This tool enables a user of the invention to work on flat or curved surfaces of up to two meters in diameter. It has the advantage of avoiding fallen edges during the polishing process as well as avoiding tool wear-out and deformation. The polishing process is repeatable by means of the control of the operational parameters of the tool, achieving high degrees of precision and accuracy on optical and semiconductor surfaces, with removal rates of 1 to 300 nm per minute per $cm^2$.

The current invention provides just such a solution by presenting a polishing tool useful for grinding and high precision, fine polishing of flat or curved optical surfaces, as well as for the optical flattening of semiconductor and metallic surfaces. The tool does not make contact with the surface to be polished and lacks moving parts; it is made of stainless steel and ceramic materials. Due to the hydrodynamic characteristics of the tool, it can create polished surfaces of high-precision optical quality. Regarding its functionality, the tool produces a high velocity flux that expands radially and parallel to the working surface, generating a stable, uniform and repeatable annular abrasion footprint. The design of the tool allows it to create an optical surface starting from the grinding process up through the final fine polishing process without having to change the tool, thereby avoiding friction against the work surface as well as tool wear. It can polish thin membranes and does not require a rigid or active support for the working surface. This invention considerably simplifies optical polishing processes and reduces costs with respect to other known methods. This tool allows for interferometric quality tests and measurements during the polishing process without the need of dismounting the working surface, thus it provides superior grinding and polishing abilities in a more efficient manner and at a reduced cost over currently available tools and methods in the field of precision polishing and grinding.

SUMMARY OF THE INVENTION

It is a principal object of the invention to provide a polishing tool useful for grinding and high precision, fine polishing of flat or curved optical surfaces, as well as for the optical flattening of semiconductor and metallic surfaces.

It is another object of the invention that the tool does not make contact with the surface to be polished.

It is an additional object of the invention that the tool lacks moving parts.

It is a further object of the invention that the tool is made of stainless steel and ceramic materials.

It is also an object of this invention that the tool can be used to create polished surfaces of high-precision optical quality.

It is an additional object of the invention that the tool operates by producing a high velocity flux that expands radially and parallel to the working surface, generating a stable, uniform and repeatable annular abrasion footprint.

It is also an object of this invention that a user of the tool be able to create an optical surface starting from the grinding process up through the final fine polishing process without having to change the tool, thereby avoiding friction against the work surface as well as tool wear.

It is an additional object of the invention that the tool can be used to polish thin membranes and does not require a rigid or active support for the working surface.

It is a further object of the invention that the tool allows for interferometric quality tests and measurements during the polishing process without the need of dismounting the working surface.

It is also an object of this invention that the tool provides superior grinding and polishing abilities in a more efficient manner and at a reduced cost over currently available tools and methods in the field of precision polishing and grinding It is a final object of this invention that the tool significantly simplifies optical polishing processes and reduces costs with respect to other known methods.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE INVENTION

The present invention is a hydrodynamic polishing tool, where the polishing principle is based on a radial flux rather than having the tool actually come into physical contact with the surface to be polished. The tool is useful for fine-grinding and polishing of optical and semiconductor surfaces, and is capable of achieving high optical qualities without making contact with the working surface.

This tool supplies a fluid with suspended abrasive particles (a "slurry" as it is known in the trade) that is propelled by means of pressurized gas (such as, preferably, air) that imprints rotational kinetic energy to the slurry, further expelling the abrasive mixture radially and parallel to the working surface, such that the abrasive particles only graze it.

The invention is useful for the fine and high precision grinding and polishing of flat or curved optical surfaces, as well as for high precision flattening of semiconductor, metallic or plastic surfaces. This tool consists of no moving parts, and is fabricated from stainless steel and abrasion resistant ceramic materials.

With this tool it is possible to grind/polish surfaces of up to 1 m in diameter; although it is possible to use arrays of two or more tools in order to work on larger surfaces. The wide spectrum of tool sizes that can be used make this tool ideal for high precision applications in small optical parts, large surfaces as well as optical quality flattening of semiconductor surfaces.

Figure 1:
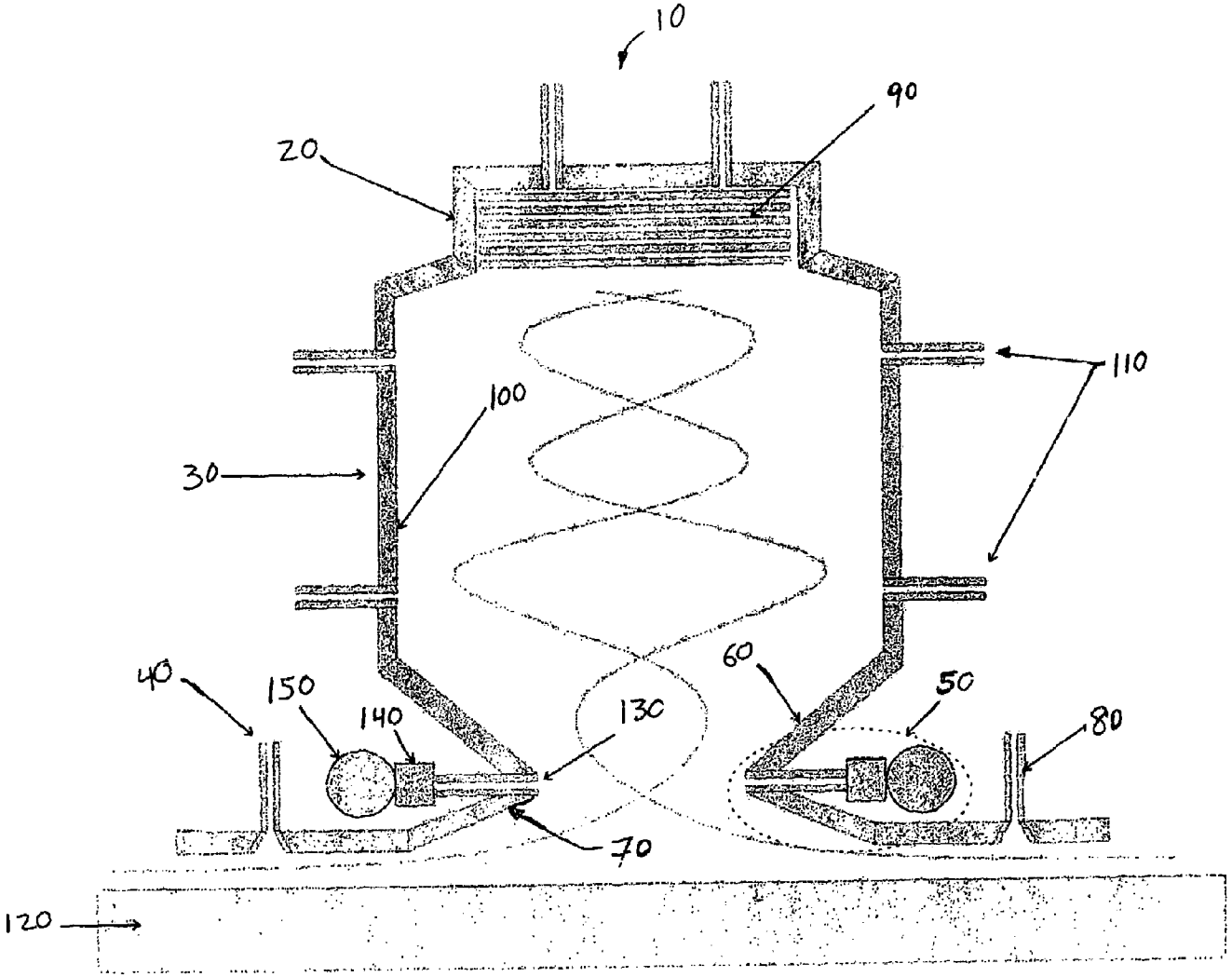
FIG. 1 is a cut-away, side view of the invention showing its different parts and method of operation.

As illustrated by FIG. 1, the present invention is a modular and interchangeable tool 10 conformed of machined cylindrical stainless steel or ceramic sections that make up each stage. A set of screws located in the periphery of the tool body, secure each stage in a stack. The tool 10 consists of: a mixing stage 20, one or more rotational acceleration stages 30, an aerostatic suspension system 40, a throat actuator 50, an output nozzle 60, a divergent radial nozzle 70 and an annular material recovering groove 80.

The mixing stage 20 controls the flux density by means of a porous cavity 90. The acceleration chambers 30 are in turn conformed by one or more cylindrical cavities 100, characterized by a hydrodynamically optimized geometry, with a series of peripherally machined power injectors 110.

The aerostatic suspension system 40 produces a fluid cushion that allows the positioning of the tool 10 with respect to the surface 120, by means of a series of aerostatic bearings, located in the periphery of the divergent section of the output nozzle 60. The throat actuator 50 consists of a continuous peripheral injector that controls the diameter of the output nozzle 60. The output nozzle 60 is a device made of stainless steel or ceramic, characterized by an optimized hydrodynamic geometry. It consists of a throat and a jet actuator, which in turn are shaped by a continuous peripheral injector 130 a stator 140, and a distribution ring 150.

The divergent radial nozzle 70 is a stainless steel device with an optimized geometry which produces a uniform and parallel flux with respect to the working surface 120, such that the abrasive particles only graze it. The annular material recovery ring 80 retrieves the residual abrasive material generated during the polishing process by means of a suction device.

Figure 2:
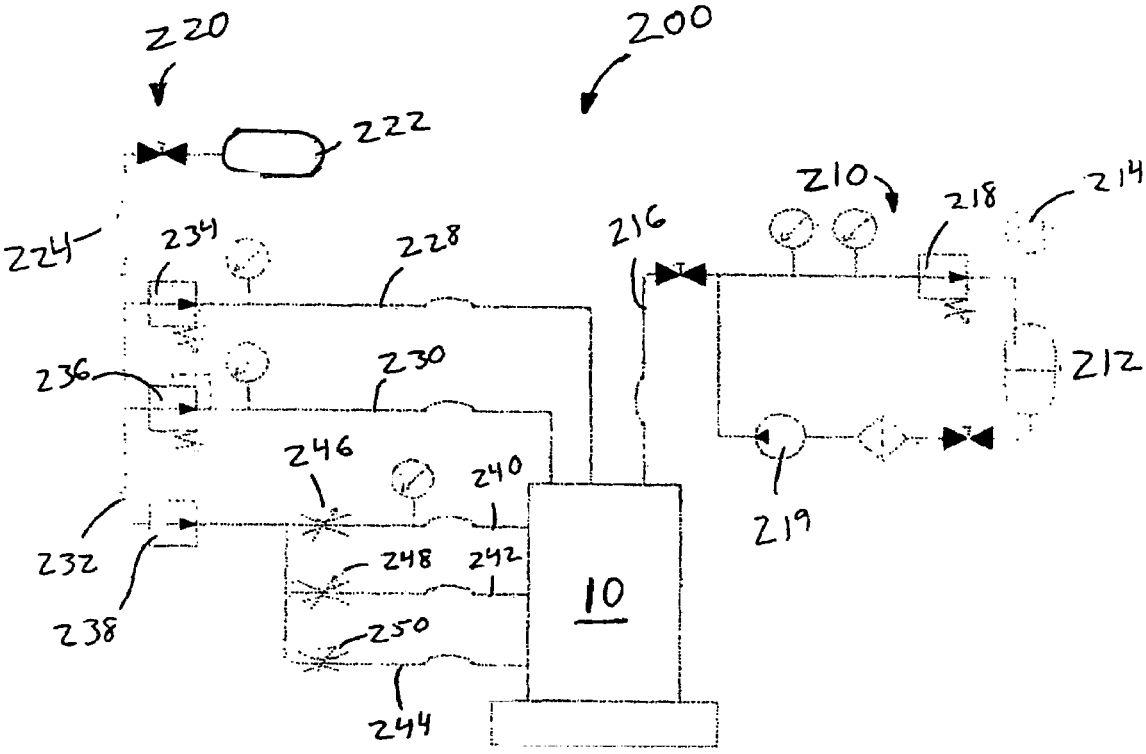
FIG. 2 is an hydraulic schematic of the invention showing its circuitry.

FIG. 2 is an electrical schematic 200 of tool 10 showing its circuitry as part of a controlled system. The tool 10 is fed by a hydro-pneumatic and control system, conformed by liquid subsystem 210 and a gas 220 subsystem. The liquid subsystem 210 consists of a permanently agitated container, a pump 214, a hydraulic line with return 216, a pressure regulator 218 and an electro-valve 219. The gas system 220 is conformed by a gas tank 222 a compressor 224, a three arm manifold 226 with pressure regulators 234, 236, and 238 for each arm 228, 230, and 232 respectively, and three sub-branches 240, 242, and 244 with respective variable flux restrictors 246, 248, and 250.

Figure 3:
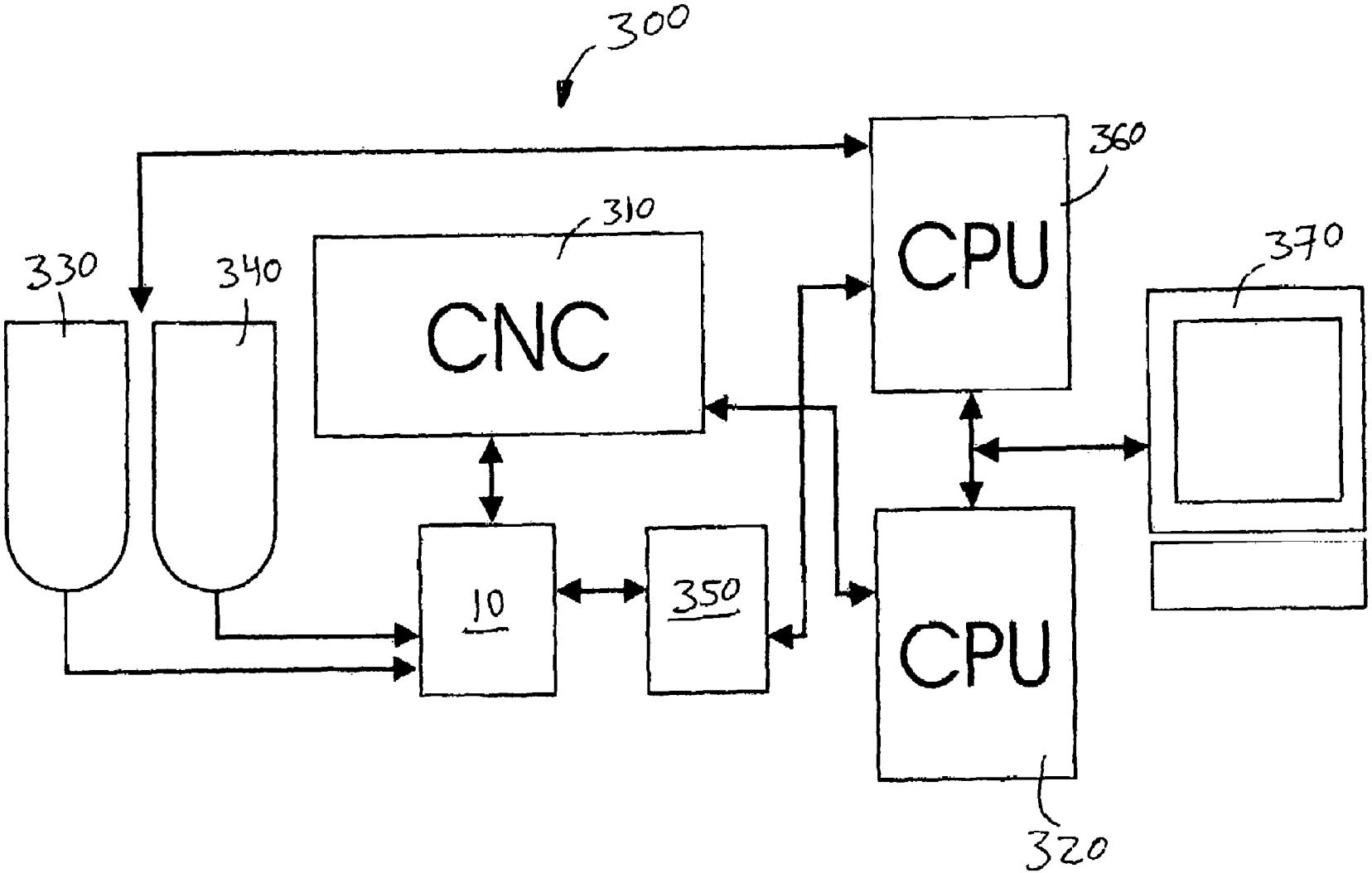
FIG. 3 is an illustrated flow chart showing how the tool can be used as part of a controlled system.

For the operation of tool 10, a control system 300 as shown in FIG. 3 can be used. The tool 10 is installed on a Cartesian or polar CNC machine 310 controlled numerically by a CPU 320. The system 300 includes an air feeding tank 330 and a slurry feeding tank 340, and a series of sensors and transducers 350 that regulate all operating parameters of the tool 10 by means of a control system 350. A computer 370 coordinates the tool 10 as well as the CNC machine 310 by means of a user interface.

EXAMPLES

This new hydrodynamic radial polishing tool allows a user to locally polish optical surfaces with controlled wear has been subject to a series of performance tests, using different types and sizes of abrasive granules, at different velocities and considering different heights of the tool with respect to the working surface.

The experimental results achieved with this tool on different surfaces of between 15 and 20 cm in diameter are described:

The invention is preferably practiced in a polishing laboratory where an r-θ-z machine is used with the invented tool installed. The entire ensemble is located inside a clear, sealed cover so that the user of the invention can see what is happening and at the same time the tool and the object whose surface is to be polished are protected from dust and other contaminants that would prevent the tool from grinding and polishing the surface to the desired degree of smoothness.

Figure 4:
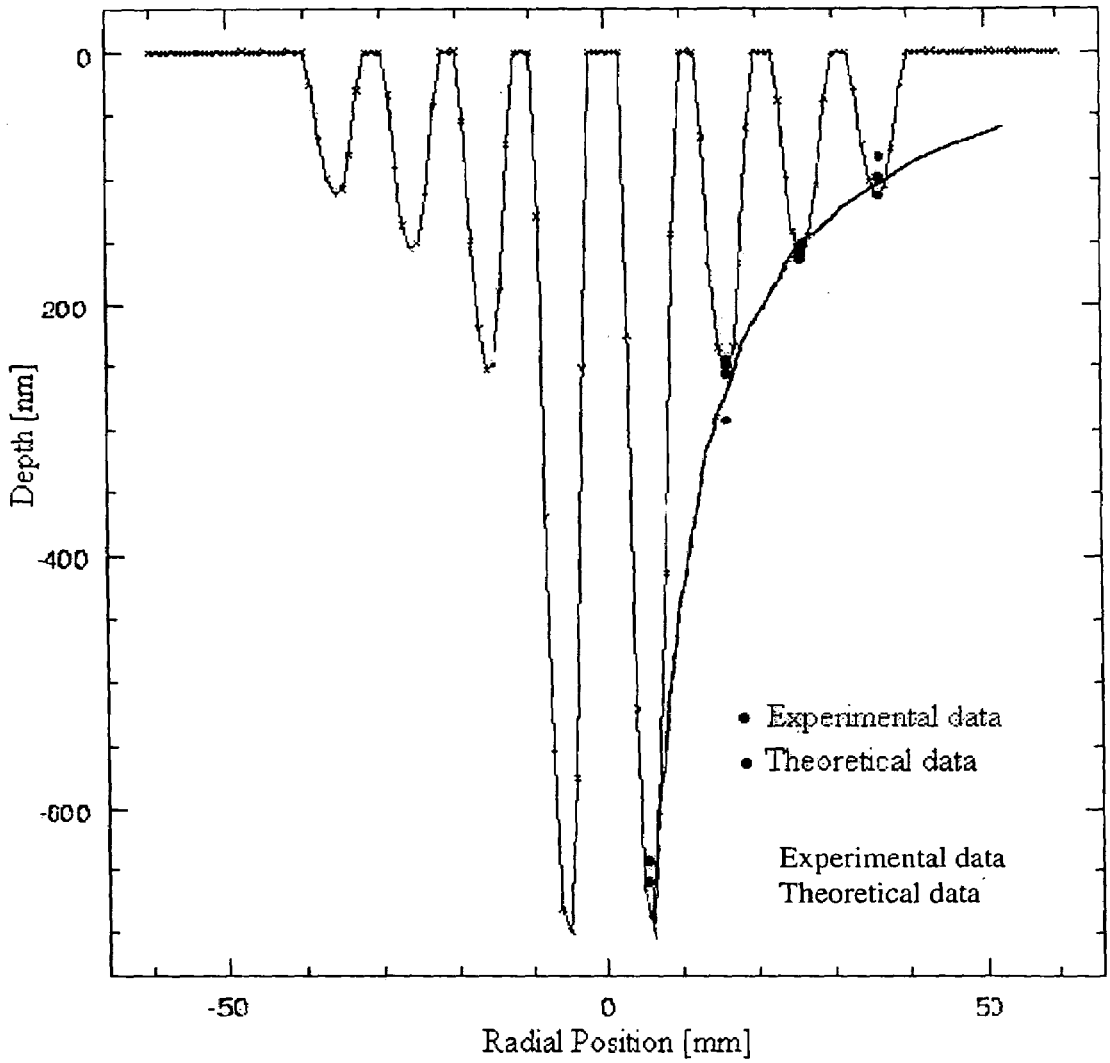
FIG. 4 shows the transversal wear profile of a set of circular grooves generated with the tool to confront its performance with a theoretical model.

FIG. 4 shows the transversal wear profile of a set of circular grooves generated with the tool to confront its performance with the theoretical model.

Figure 5:
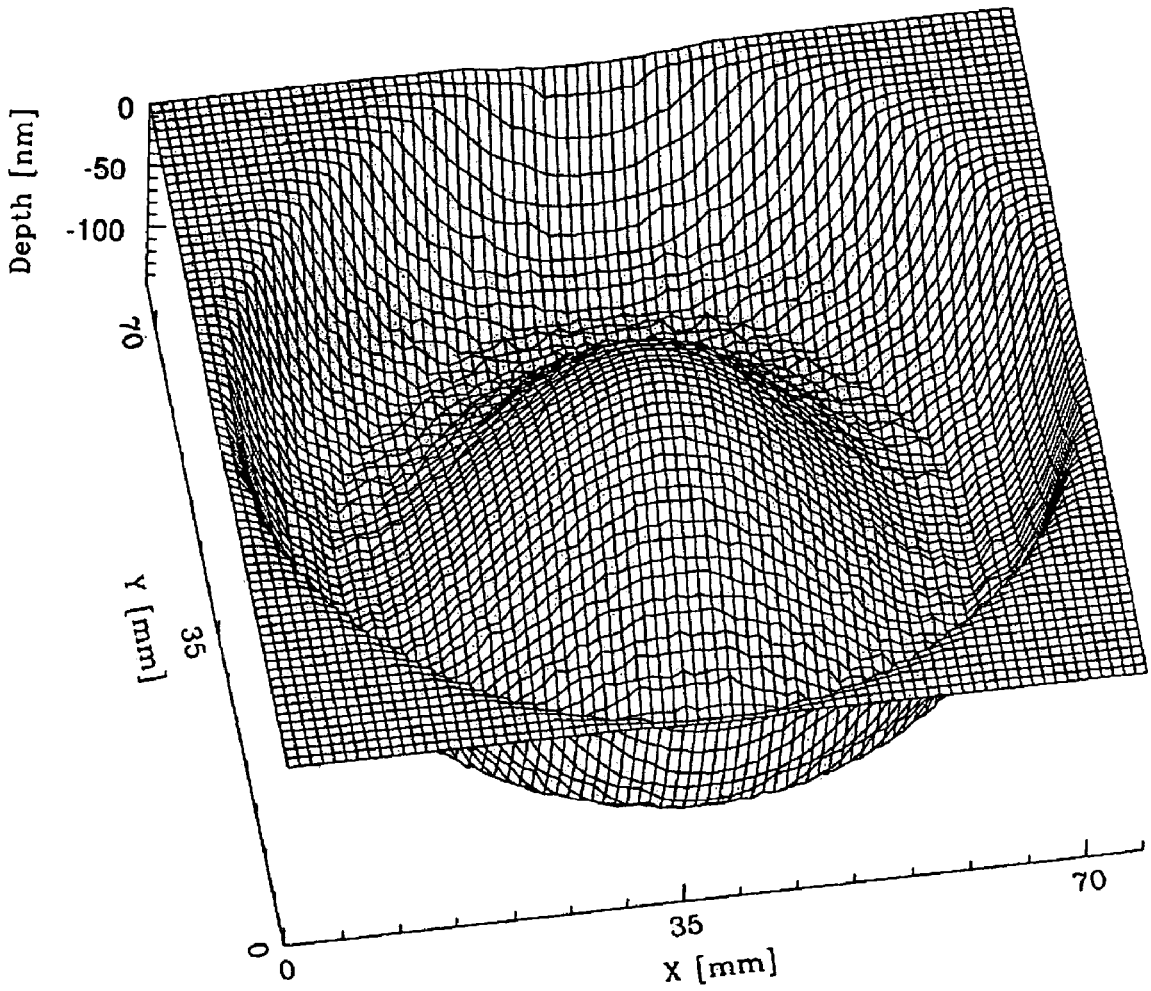
FIG. 5 shows a numerical simulation of such a surface which was used to program the tool controller in order to generate this surface.

The tool presented here can also polish aspheric surfaces such as a correcting Schmidt surface. FIG. 5 shows a numerical simulation of such a surface which was used to program the tool controller in order to generate this surface.

A computer reconstruction of the interferometrically analysed wavefront of the Schmidt surface that was polished in FIG. 5 using the tool gave an accuracy of 13 nm rms. The observed shading corresponded to phase deconvolution errors and do not correspond to wavefront errors. The instrument is capable of detecting surface errors down to 2 nm when abrasive particles of 5 μm are used.

Figure 6:
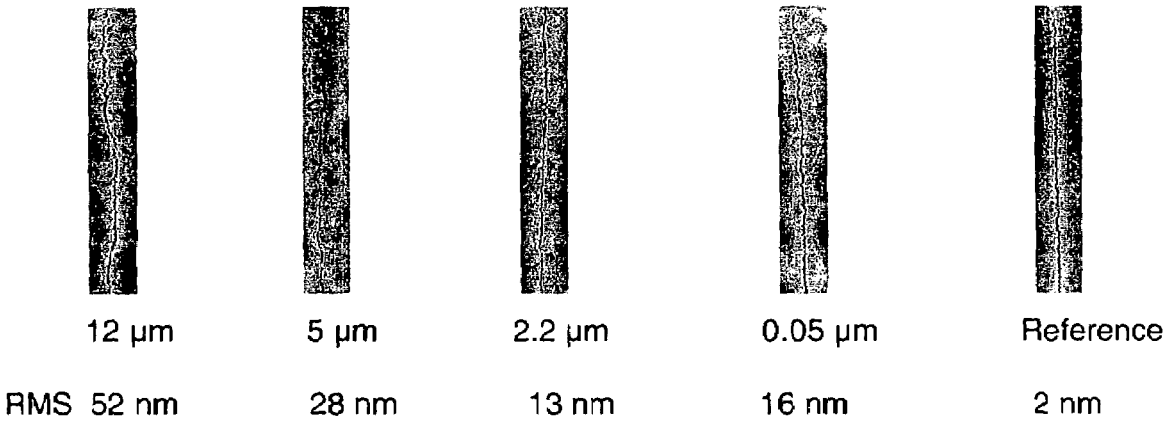
FIG. 6 shows an interferometric fringe distortion analysis of surfaces polished with the invention using abrasive particles of different sizes and materials.

FIG. 6 shows an interferometric fringe distortion analysis of surfaces polished with the invention using abrasive particles of different sizes and materials. The figure to the far right shows the fringe profile of an optical reference surface plate.

We claim:

1. A high precision polishing tool for fine grinding and polishing of flat or curved optical surfaces, as well as for the optical flattening of semiconductor and metal surfaces, comprising:

a plurality of cylindrical sections made of previously machined stainless steel or ceramic, where, the plurality of cylindrical sections are coupled to each other by means of a series of peripheral screws, said cylindrical sections consisting of a mixing module, where the mixing module mixes two or more components of a polishing mixture, a module comprising one or more rotational acceleration chambers, an aerostatic suspension system, a throat actuator, a material recovery groove, an output nozzle and a divergent radial nozzle.

2. The tool of claim 1, where, the mixing module has a means for the density control of the polishing mixture, where the means is a porous cavity.

3. The tool of claim 1, where, the one or more rotational acceleration chambers consist of one or more cylindrical cavities characterized by an optimized hydrodynamical geometry, and, where, on the periphery of said one or more rotational acceleration chambers there exists a set of power injectors which are machined onto the surface of the one or more rotational acceleration chambers.

4. The tool of claim 1, where, the aerostatic suspension system generates a fluid layer over which the tool floats, and where the fluid layer allows the user of the tool to adjust the position of the tool with respect: to the surface by means of a series of aerostatic bearings.

5. The tool of claim 1, where, the said throat actuator consists of a continuous peripheral injector that controls the output nozzle diameter.

6. The tool of claim 1, where, the output nozzle consists of a stainless steel or ceramic device with a hydrodynamically optimized geometry.

7. The tool of claim 6, where the output nozzle is comprised of a throat and a jet actuator, where the jet actuator is shaped by a continuous peripheral injector, a stator, and a distribution ring.

8. The tool of claim 1, where, the divergent radial nozzle is a stainless steel or ceramic device with a hydrodynamically optimized geometry that produces a uniform radial and parallel flux in a direction towards the working surface such that the abrasive particles only graze the surface.

9. The tool of claim 1, where, the material recovery ring picks up the polishing process residual abrasive material by means of a suction mechanism.

10. A method for the corrective grinding, fine polishing and cleansing of smooth surfaced, including surfaces coated with metals and thin films, of diverse rigid and semi-rigid materials of medium and high hardpess as well as for the polishing and flattening of semiconductor surfaces, the method comprising the steps of:

providing a high precision polishing tool for fine grinding and polishing of flat or curved optical surfaces, as well as for the optical flattening of semiconductor and metal surfaces, the tool comprising:

a plurality of cylindrical sections made of previously machined stainless steel or ceramic, where, the plurality of cylindrical sections are coupled to each other by means of a series of peripheral screws, said cylindrical sections consisting of a mixing module, where the mixing module mixes two or more components of a polishing mixture, a module comprising one or more rotational acceleration chambers, an aerostatic suspension system, a throat actuator, a material recovery groove, an exit nozzle and a divergent radial nozzle;

providing a flat or curved optical surface;

grinding the flat or curved optical surface with the tool;

polishing the flat or curved optical surface with the tool; and cleansing the flat or curved optical surface.

11. The method of claim 10, where, the mixing module has a means for the density control of the polishing mixture, where the means is a porous cavity.

12. The method of claim 10, where, the one or more rotational acceleration chambers consist of one or more cylindrical cavities characterized by an optimized hydrodynamical geometry, and, where, on the periphery of said one or more rotational acceleration chambers there exists a set of power injectors which are machined onto the surface of the one or more rotational acceleration chambers.

13. The method of claim 10, where, the aerostatic suspension system generates a fluid layer over which the tool floats, and where the fluid layer allows the user of the tool to adjust the position of the tool with respect to the surface by means of a series of aerostatic bearings.

14. The method of claim 10, where the said throat actuator consists of a continuous peripheral injector that controls the output nozzle diameter.

15. The method of claim 10, where, the output nozzle consists of a stainless steel or ceramic device with a hydrodynamically optimized geometry.

16. The method of claim 15, where the output nozzle is comprised of a throat and a jet actuator, where the jet actuator is shaped by a continuous peripheral injector, a stator, and a distribution ring.

17. The method of claim 10, where, the divergent radial nozzle is a stainless steel or ceramic device with a hydrodynamically optimized geometry that produces a uniform radial and parallel flux in a direction towards the working surface such that the abrasive particles only graze the surface.

18. The method of claim 10, where, the material recovery ring picks up the polishing process residual abrasive material by means of a suction mechanism.

19. A high precision polishing tool for fine grinding and polishing of flat or curved optical surfaces, as well as for the optical flattening of semiconductor and metal surfaces, comprising:

a plurality of cylindrical sections made of previously machined stainless steel or ceramic, where, the plurality of cylindrical sections are coupled to each other by means of a series of peripheral screws, said cylindrical sections consisting of a mixing module, where the mixing module mixes two or more components of a polishing mixture, a module comprising one or more rotational acceleration chambers, an aerostatic suspension system, a throat actuator, an exit nozzle and a radial, divergent nozzle, where, the mixing module has a means for the density control of the polishing mixture, where the means is a porous cavity, and, where, the one or more rotational acceleration chambers consist of one or more cylindrical cavities characterized by an optimized hydrodynarnical geometry, and, where, on the periphery of said one or more rotational acceleration chambers there exists a set of power injectors which are machined onto the surface of the one or more rotational acceleration chambers, and, where, the aerostatic suspension system generates a fluid layer over which the tool floats, and where the fluid layer allows the user of the tool to adjust the position of the tool with respect to the surface by means of a series of aerostatic bearings.

20. The tool of claim 19, where, the said throat actuator consists of a continuous peripheral injector that controls the output nozzle diameter, and, where, the output nozzle consists of a stainless steel or ceramic device with a hydrodynamically optimized geometry, and, where, the output nozzle is comprised of a throat and a jet actuator, where the jet actuator is shaped by a continuous peripheral injector, a stator, and a distribution ring, and, where, the divergent radial nozzle is a stainless steel or ceramic device with a hydrodynamically optimized geometry that produces a uniform radial and parallel flux in a direction towards the working surface such that the abrasive particles only graze the surface, and, where, the material recovery ring picks up the polishing process residual abrasive material by means of a suction mechanism.

* * * * *